US008897658B2

(12) United States Patent
Kendall

(10) Patent No.: US 8,897,658 B2
(45) Date of Patent: Nov. 25, 2014

(54) METHOD AND SYSTEM FOR ESTIMATING TONER REMAINING IN A CARTRIDGE

(75) Inventor: David R. Kendall, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1550 days.

(21) Appl. No.: 11/606,724

(22) Filed: Nov. 30, 2006

(65) Prior Publication Data

US 2008/0131146 A1 Jun. 5, 2008

(51) Int. Cl.
*G03G 15/08* (2006.01)
*G03G 15/00* (2006.01)

(52) U.S. Cl.
CPC ..... *G03G 15/0831* (2013.01); *G03G 15/556* (2013.01); *G03G 2215/0888* (2013.01); *G03G 15/553* (2013.01)
USPC ..... 399/27; 399/61

(58) Field of Classification Search
USPC ..... 399/27–30, 35, 49, 61–65, 106, 120
See application file for complete search history.

(56) References Cited

U.S. PATENT DOCUMENTS 5,794,094 A 8/1998 Boockholdt et al.
5,802,420 A * 9/1998 Garr et al. ..... 399/27
5,970,275 A 10/1999 Brown, Jr. et al.
5,995,774 A 11/1999 Applegate et al.
6,128,094 A 10/2000 Smith
6,173,134 B1 1/2001 Nishimura et al.
6,295,423 B1 9/2001 Haines et al.
6,347,198 B1 2/2002 Yamamoto et al.
6,427,054 B1 7/2002 Ohkubo et al.
6,453,129 B1 9/2002 Simpson et al.
6,456,802 B1 9/2002 Phillips
6,476,837 B2 11/2002 Ogata
6,510,292 B1 1/2003 Owen et al.
6,515,759 B1 2/2003 Smith
6,584,291 B1 6/2003 Yamamoto et al.
6,587,649 B1 7/2003 Yamamoto et al.
6,629,134 B2 9/2003 Hayward et al.
6,641,312 B1 11/2003 Chang et al.
6,718,147 B1 4/2004 Carter et al.
6,746,094 B1 6/2004 Powell et al.
6,791,704 B1 9/2004 Moreau et al.
6,792,216 B2 9/2004 Wachter et al.
6,798,997 B1 9/2004 Hayward et al.
6,801,731 B2 10/2004 Parker
6,871,926 B2 3/2005 Adkins et al.
6,903,837 B1 6/2005 Moreau et al.
6,977,755 B2 12/2005 Payne et al.
7,013,092 B2 3/2006 Hayward et al.
7,054,566 B2 5/2006 Uyama
7,058,320 B2 6/2006 Yamamoto et al.
2005/0078130 A1 * 4/2005 Fernandez ..... 347/7

FOREIGN PATENT DOCUMENTS

JP 2003219070 A * 7/2003

* cited by examiner

*Primary Examiner* — G. M. Hyder

(57) ABSTRACT

A method of estimating a quantity of toner remaining in a toner cartridge includes using an adaptive term, a value of which is adjusted based on actual printer toner usage. A printer configured to produce an estimate of an amount of toner remaining in a toner cartridge installed in that printer includes a toner remaining algorithm; and an adaptive term, a value of which is adjusted based on actual printer toner usage rate. The algorithm uses the adaptive term to produce the estimate of an amount of toner remaining in the toner cartridge.

19 Claims, 4 Drawing Sheets

METHOD AND SYSTEM FOR ESTIMATING TONER REMAINING IN A CARTRIDGE

RELATED PATENT

The present application is related to U.S. Pat. No. 5,794,094, issued Aug. 11, 1998 to Boockholdt et al., which is incorporated by reference herein in its entirety.

BACKGROUND

Modern printing devices such as printers, copiers, and fax machines use certain materials that are consumed in the operation of the device. Examples of such materials include toner and a print medium, such as paper. The device manufacturer and other manufacturers will normally provide toner in a disposable cartridge that can be discarded when the contained toner is consumed. A new cartridge is then installed in the printing device.

For many users, the replacement of a toner cartridge represents both an inconvenience in time and an expense to purchase a new toner cartridge or refill the old one. Consequently, users appreciate being able to track toner usage and have an indication of the amount of toner remaining in a current toner cartridge. Some relatively sophisticated toner cartridges include a sensor that will actually sense the quantity of toner remaining in the cartridge with the result being reported to a user. Such a sensor, however, clearly adds expense and complexity to the printer. Therefore, other printing systems have taken a different approach, attempting to estimate the quantity of toner remaining in a cartridge. Such estimation techniques are typically based on the average behavior of that particular make and model of the printer, with each printer of that make and model estimating toner usage using the same parameters.

However, the rate at which toner is used in a printer is a function of many different variables, many of which are not specific to the make and model of the printer. For example, some of these variables depend upon the ambient environment in which the printer is deployed and used. Such environmental variables include, for example, temperature, humidity, altitude, etc. Other variables that bear on the rate of toner consumption depend on the kind of usage the printer experiences. Such usage variables include, for example, average print job length, mix of color versus monochrome print jobs, wear or age of components, etc. Other variables that bear on the rate of toner consumption result from variations that exist from printer to printer due to tolerances in manufacturing processes. Such printer-specific variables include, for example, sensor accuracies, component variations, etc.

As a result of these many different variables that help determine the rate at which toner is consumed, the actual toner consumption rate will vary, perhaps widely, from printer to printer. This is true even if the printers in question are of the same make and model. Therefore, if a printer relies on some form of open loop analytical computation to estimate toner remaining, as opposed to direct measurement from a sensor, the computation may be accurate for the average printer performance, but will not be accurate for many individual printers. Consequently, traditional methods of estimating toner usages based on the make and model of the printer have demonstrated a relatively low level of accuracy.

BRIEF DESCRIPTION OF THE DRAWINGS

The accompanying drawings illustrate various embodiments of the principles disclosed herein and are a part of the specification. The illustrated embodiments are merely examples and do not limit the scope of the claims.

Throughout the drawings, identical reference numbers designate similar, but not necessarily identical, elements.

DETAILED DESCRIPTION

Figure 1:
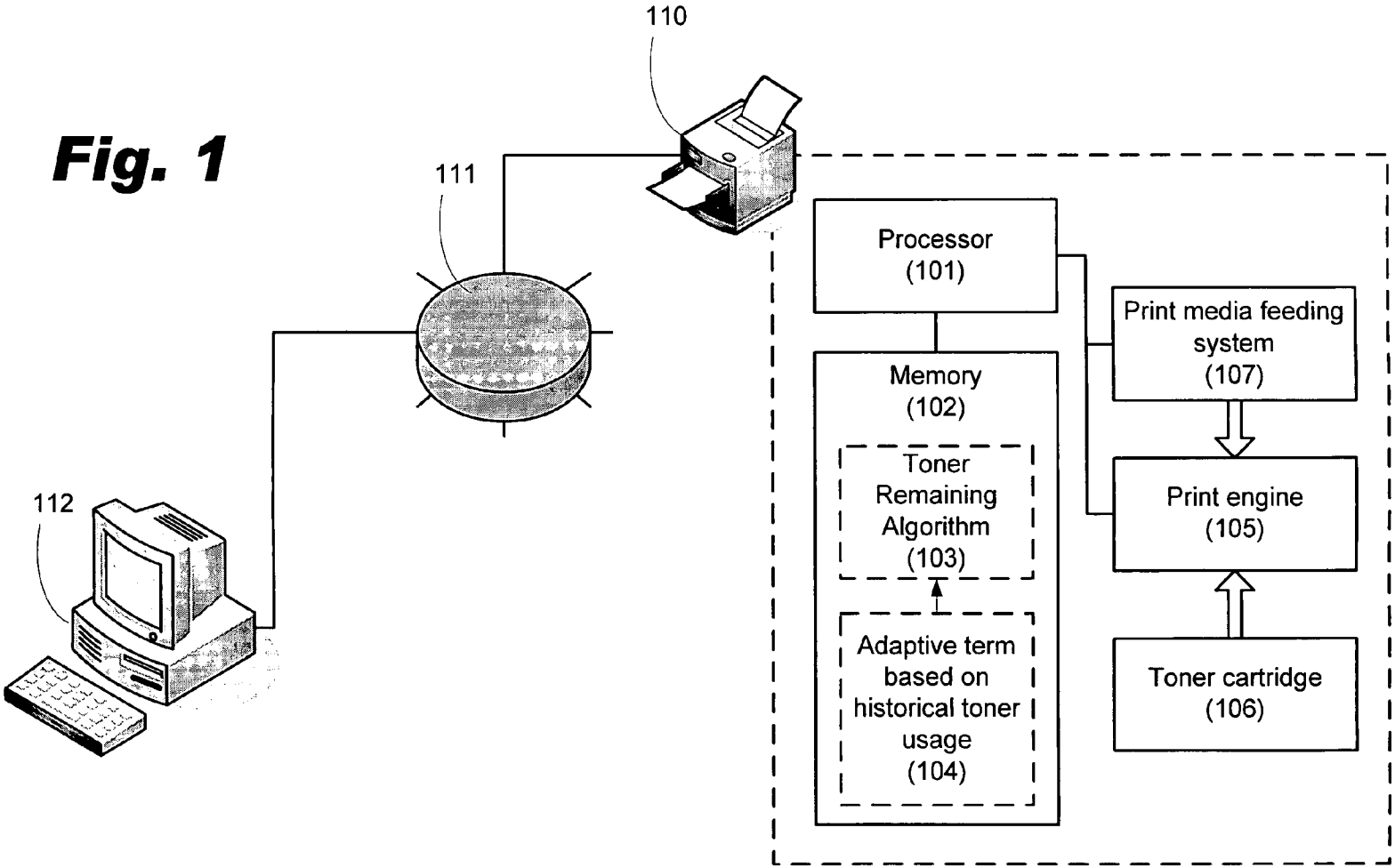
FIG. 1 illustrates a system according to principles described herein that allows an estimate of toner quantity remaining in a printer based on historical toner usage behavior for that particular printer.

This present specification describes methods and systems for calculating a quantity of toner remaining in a toner cartridge that is currently in service based on the amount of wear incurred, the number and tone level of pixels printed, and the actual performance the printer has demonstrated in depleting previous toner cartridges, i.e., reaching a "toner out" condition or other condition late in the life of the cartridge where the quantity of toner remaining can be determined accurately. Such data based on actual toner usage within a particular printer allows for a more reliable and consistent indicator of the quantity of toner remaining in a current toner cartridge than does data describing toner usage generally across similar printers.

As used herein including in the appended claims, the term "printer" or "printing device" will be used broadly to refer to any device that produces a desired hardcopy document using electronic data. As such, the terms "printer" and "printing device" include, but are not limited to, printers, including laser printers and inkjet printers; copiers; fax machines; multi-function peripherals, etc.

As used herein including in the appended claims, the term "toner" is used broadly to refer to any marking substance dispensed by a printer onto a print medium to produce a desired hardcopy document. As such, the term "toner" may include, but is not limited to, toner, ink, colorant, marking fluid, etc.

In the following description, for purposes of explanation, numerous specific details are set forth in order to provide a thorough understanding of the present systems and methods. It will be apparent, however, to one skilled in the art that the present systems and methods may be practiced without these specific details. Reference in the specification to "an embodiment," "an example" or similar language means that a particular feature, structure, or characteristic described in connection with the embodiment or example is included in at least that one embodiment, but not necessarily in other embodiments. The various instances of the phrase "in one embodiment" or similar phrases in various places in the specification are not necessarily all referring to the same embodiment.

There are many, many variables that can have an effect on how quickly or slowly a toner cartridge is depleted. As mentioned above, some of these variables depend upon the ambient environment in which the printer is deployed and used.

Such environmental variables include, for example, temperature, humidity, altitude, etc. Other variables that bear on the rate of toner consumption depend on the kind of usage the printer experiences. Such usage variables include, for example, average print job length, mix of color versus monochrome print jobs, wear or age of components, etc. Other variables that bear on the rate of toner consumption result from variations that exist from printer to printer due to tolerances in manufacturing processes. Such printer-specific variables include, for example, sensor accuracies, component variations, etc. These are just some of the relevant variables that can have an effect on how quickly or slowly a toner cartridge is depleted.

Another way of looking at the host of variables involved in the depletion of a toner cartridge is to divide some of the variables into two categories, variables that occur during intentional toner consumption and variables that occur during unintentional toner consumption. Both the rate at which toner is intentionally used or consumed and the rate at which toner is unintentionally used or consumed will determine the actual printable toner remaining.

Examples of variables effecting toner consumption rate that occur when toner is intentionally used, i.e., to produce a hardcopy document based on a print job or other data input, include the print parameters selected by the user such as the number of calibrated tone pixels, selected half-tones, adjustable color settings and pattern dependencies. Other variables effecting the toner consumption rate that occur when toner is intentionally used include, but are not limited to, anti-counterfeit yellow dots, calibration patches and toner purge operations that clean worn toner from the developer.

Examples of variables effecting toner consumption rate that occur when toner is unintentionally used, i.e., toner wasted or expended but not to produce an image on a print medium, include, but are not limited to, toner leaking and dusting, variations in printer process settings, color calibration drift and inaccuracy, inaccurate correlation between tone level and toner quantity, and toner expended in unprintable areas such as margins, inter-document zones and during idle rotations of the print drum or developer roller such as for a slow processor.

The classic approach to accuracy in making an estimation is to capture all inputs to the system, characterize the effects of each and then account or compensate for the effect of each input and any interaction between two existing inputs. However, given the number and nature of the variables that effect toner use rate, as outlined partially above, it is not realistic to take this classic approach.

As an alternative, we presume that the toner usage behavior will be reasonably consistent in a given printer. Many of the variables that effect toner consumption rates should be consistent for a given printer as between at least two successive toner cartridges used. For example, the ambient conditions in which the printer is operated are presumably consistent, any variables specific to the manufacture or age of that printer will remain reasonably consistent, the pattern of usage for that printer will presumably remain reasonably consistent, etc.

Consequently, using an adaptive algorithm that takes into account the previous toner usage behavior of a specific printer will allow a better estimation of the quantity of toner remaining in a toner cartridge than is possible with algorithms that operate based only on parameters defined by the average behavior of given make and model of printer. This improvement in accuracy may be, based on experimental work done, a 56% to 80% reduction in estimation error.

FIG. 1 illustrates a system according to principles described herein that allows an estimate of toner quantity remaining in a printer's toner cartridge based on historical toner usage behavior for that particular printer. As shown in FIG. 1, a printer or printing device (110) is connected to a host computer (112). The printer (110) may, in some instances, be connected to the host computer (112) through a network (111).

The network (111) may be any network including, but not limited to, a Local Area Network, a Wide Area Network or a global network such as the Internet. The network (111) may include some wireless networking or may be entirely wireless.

The host computer (112) can be any computing device including, but not limited to, a desktop computer, laptop computer, notebook computer, tablet computer, workstation, mainframe, server, personal digital assistant, etc. The host computer (112) illustrated represents any device that a user employs to submit print jobs to the printer (110) and/or to control or communicate with the printer (110).

As further shown in FIG. 1, the printer (110) includes a print engine (105) that is used to produce hardcopy documents based on electronic data. Various different types of print engines may be used depending on the type of printer. A toner cartridge (106) provides the toner used by the print engine (105). As printing occurs, the toner in the cartridge (106) is eventually depleted, and the toner supply must be replenished. The cartridge (106) may be replaced with a new cartridge or may simply be refilled and reinstalled.

In addition to the toner cartridge (106), the printer (110) will also include or have available a supply of print media. The print media may include, but is not limited to, paper-based media, plastic-based media and cloth-based media. A print media feeding system (107) is employed to feed the print media, typically sheet by sheet, to the print engine (105) for printing.

A processor (101) receives or, in some cases, generates the electronic data used by the print engine (105). The processor (101) also controls the print media feeding system (107) and the print engine (105) to produce the desired hardcopy document from that electronic data. The processor (101) may be, for example, an application specific integrated circuit.

Firmware executed by the processor (101) is stored in a memory (102) that is connected or accessible to the processor (101). This firmware includes a toner remaining estimation algorithm (103) according to principles disclosed herein that continuously or periodically produces an estimate of the amount of toner remaining in the toner cartridge (106). The result of that estimation can be transmitted by the printer (110) to the host computer (112). Alternatively or additionally, the estimation of the amount of toner remaining may be displayed or otherwise indicated on a user interface of the printer (110) itself.

As shown in FIG. 1, the toner remaining algorithm (103) will use an adaptive term (104) that will be described in more detail below. This adaptive term (104) will be developed based on the past toner usage behavior of the specific printer (110) in which it is stored. The adaptive term (104) can be updated or modified over time to better reflect the current toner usage behavior of the printer (110).

With this adaptive term (104), the toner remaining algorithm (103) becomes specific to that particular printer (110) in which it is executed. Consequently, it becomes less important that we cannot characterize and account for every variable that may affect the toner usage rate. All such variables, to the extent they remain reasonably consistent over time, are taken into account through the adaptive term (104) that is based on actual toner usage history. As indicated above, this dramatically increases the accuracy of the toner remaining algorithm (103) in producing an estimate of the toner quantity actually remaining in the toner cartridge (106).

Figure 2:
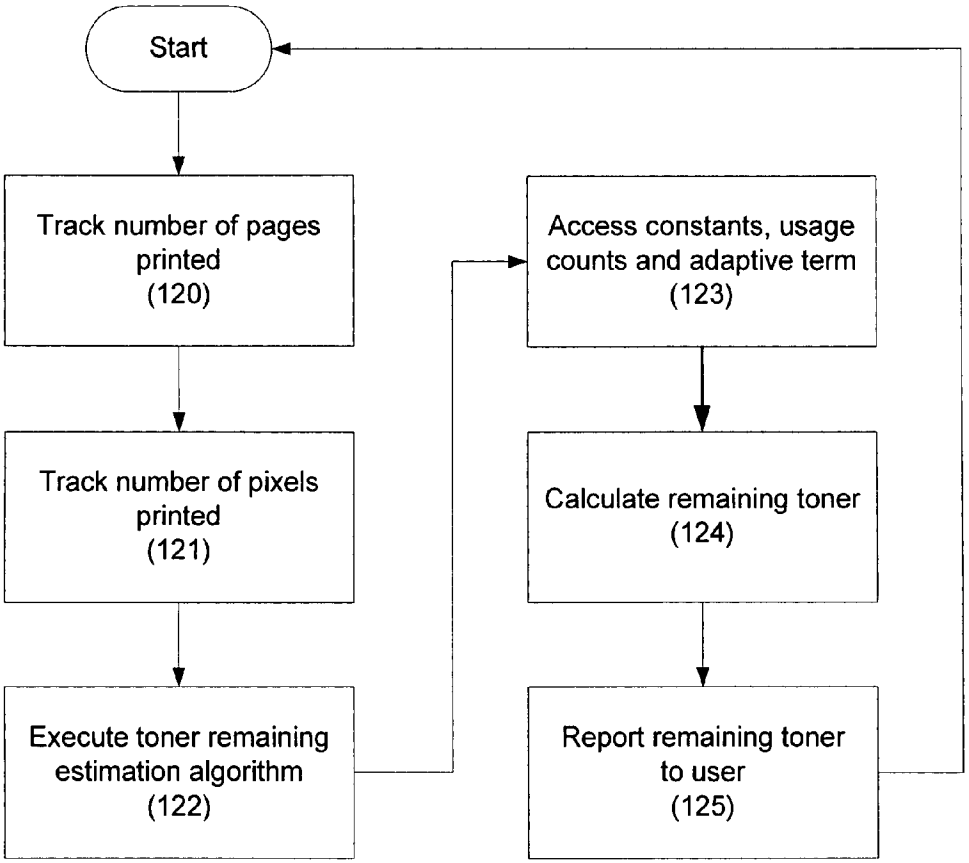
FIG. 2 is a flowchart illustrating a method, according to principles described herein, of estimating the amount of toner remaining in a toner cartridge that is currently in service.

FIG. 2 is a flowchart illustrating a method, according to principles described herein, of estimating the amount of toner remaining in a toner cartridge that is currently in service. As shown in FIG. 2, the method includes tracking the wear incurred with the current toner cartridge (step 120). Referring again to FIG. 1, the processor (101) is connected to, and controls, the print media feeding system (107). The processor (101) also controls the print engine (105) which, in some examples, includes motors, clutches, sensors, a print drum and/or developer roller, each cycle of which can be counted to give an indication of the wear incurred on the current toner cartridge. Consequently, the processor (101) may include a counter that counts the cycles of a mechanism of the print engine such as a print drum or developer roller or that counts the number of sheets or pages of print media that have been fed by the feeding system (107) to the print engine (105) for printing during the use of the current toner cartridge (106). As needed, this count can be stored and updated in the memory (102), for example, in a non-volatile portion of the memory (102).

Returning to FIG. 2, the method next includes tracking the number of pixels printed (step 121). As above, the processor (101), which controls and sends data to the print engine (105), can count the number of pixels printed based on the image data being sent to the print engine (105). As needed, this count can be stored and updated in the memory (102), for example, in a non-volatile portion of the memory (102).

When an estimate of the quantity of toner remaining is desired, the toner remaining estimation algorithm (103, FIG. 1) is executed (step 122). In some embodiments, this algorithm is executed after each page is printed with the result being integrated to estimate the toner remaining. In other embodiments, the algorithm is executed after each print job is completed.

The algorithm uses a formula that equates a quantity of toner used with a number and tone of the pixels printed as adjusted with a factor indicative of the wear on the toner cartridge and the adaptive term described herein that accounts for that particular printer's previous toner usage behavior. One possible example of such a formula follows as formula (1) and can be used by the algorithm to estimate the toner used for given page or for a print job.

$$\text{Toner used}=(\text{Number indicating wear incurred})\cdot(\text{Wear Constant})+(\text{Number indicating the number and tone of pixels printed})\cdot(\text{Pixel Constant})\cdot(\text{Adaptive Term}) \quad (1)$$

The "number indicating wear incurred" accounts for the fact that, as components of the toner cartridge experience wear over the life of the cartridge, the performance of those components will degrade. The variance from optimal performance tends to increase slowly at first, then accelerates with age. The "number indicating wear incurred" can be determined in a number of ways. In the present example, it is based on the number of pages printed. As noted above, the wear incurred or the number of pages printed can be tracked in any of several ways. This number accounts for inter-document gaps and idle rotations of a print drum or developer roller due to job length, print media size or data processing inefficiency. The "number indicating the number and tone of pixels printed" is or is based on the number of pixels printed.

The "wear constant" is based on and accounts for toner lost in the background of each page, for example, in margins or unprintable areas, in between documents or pages, etc. It represents the amount of toner lost per unit of wear given by the "number representing wear." The wear constant is thought to represent a small factor in toner usage. The wear constant can generally be determined for each make and model of printer and, since it is a relatively small factor, may even be consistent across different platforms. The wear constant, once determined, remains constant and can be stored in the firmware or non-volatile memory of the printer for use by the toner remaining algorithm. In some examples, the wear constant may be set to zero. This reflects printer configurations in which there is little or no loss of toner in the white space of the pages printed, such as in inkjet printers, and the amount of wear on the cartridge is therefore negligible to the calculation of toner used.

The "pixel constant" is related to the amount of toner per pixel a cartridge is expected to print. This is a known quantity based on, for example, manufacturer specifications or the number of pixels on a yield or test page. As with the wear constant, the pixel constant, once determined for a particular cartridge, remains constant and can be stored in the firmware or non-volatile memory of the printer for use by the toner remaining algorithm.

The "adaptive term," as indicated above, is intended to capture and account for the previous toner usage behavior of a particular printer. The adaptive term is initially set to unity and then, as described in more detail below, is adjusted over time to correct the results of the toner remaining algorithm based on the actual performance, i.e., toner usage rate, of the printer in question. As indicated in FIG. 1, the adaptive term is also stored in the firmware or non-volatile memory of the printer for use by the toner remaining algorithm.

Consequently, upon execution, the toner remaining algorithm will access the constants, usage counts and the adaptive term described above (step 123). The algorithm will then calculate the number indicating wear incurred and the number indicating the number and tone of pixels printed from the usage counts and will apply those results along with the constants and the current adaptive term to the formula (1) given above.

This results in an estimated amount of toner used per page or per print job that can be subtracted from the last estimate of toner remaining or from the total amount of toner in a full cartridge, if this is the first usage of a newly-installed cartridge. By this process, the algorithm calculates an estimate of the amount of toner remaining in the cartridge (step 124). As indicated, the toner remaining algorithm can be run on either a page-by-page or job-by-job basis.

The estimate of toner remaining is then reported to a user (step 125). As indicated above, this may be performed with a user interface on the printer that is running the algorithm or may be performed by transmitting the estimate of toner remaining to a computing device (e.g., host 112, FIG. 1) that the user employs to control or communicate with the printer (110). The results of the algorithm can be reported periodically or only when requested by the user.

Figure 3:
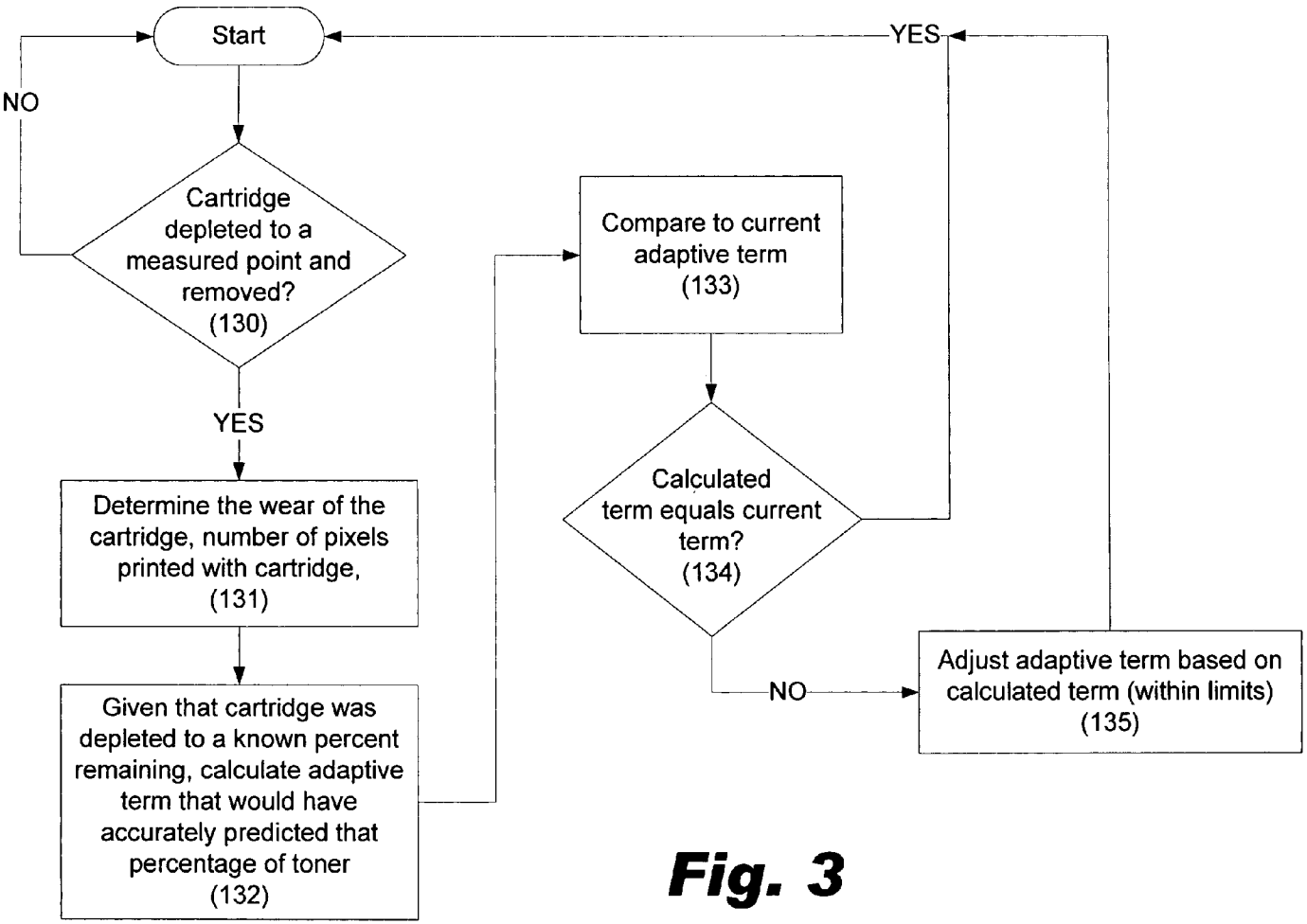
FIG. 3 is a flowchart illustrating a method, according to principles described herein, of updating or tuning the adaptive term used to represent previous toner usage behavior for a particular printer in the estimation process of the amount of toner remaining in a toner cartridge currently in service.

FIG. 3 is a flowchart illustrating a method, according to principles described herein, of updating or tuning the adaptive term used to represent previous toner usage behavior for a particular printer in the estimation process of the amount of toner remaining in a toner cartridge currently in service. As shown in FIG. 3, the adaptive term is evaluated each time the current toner cartridge is fully depleted or depleted to some other measured point (determination 130).

When the cartridge actually runs out of toner, we know that the actual toner usage has, by definition, reached 100%, regardless of any estimate that may or may not be accurate. Consequently, one can correlate the quantity of ink expended (i.e., 100%) with the amount of printing actually accomplished with that quantity of ink and can then update the adaptive term accordingly as will be described in detail below.

If the cartridge is fully depleted or depleted to a known quantity (determination 130), the total number of pages printed using the cartridge and the total number of pixels printed using the cartridge is determined (step 131). This can be done based on the counts described above that are kept of pages and pixels printed. Alternatively, the wear on the cartridge to that point can be quantified by some measure other than number of pages printed.

Next, formula (1) is again employed. If the cartridge was fully depleted, the amount of toner used (on the left side of the equation) is set to the amount of toner that a full cartridge should contain. Knowing that 100% of the toner has been expended, the amount of toner used should equal the amount of toner the cartridge contained. Or, if the cartridge was not fully depleted, but depleted to some known or measured remaining quantity, the amount of toner used (on the left side of the equation) is set to that known amount of toner remaining. The wear on the cartridge (e.g., based on total number of pages) and the number of pixels printed, along with the constants, are plugged into the formula (1), and the formula is solved for what the adaptive term should have been to have accurately predicted the printer's actual experience with the now discarded toner cartridge. (Step 132).

This calculated adaptive term is then compared to the current adaptive term that is being stored and used by the printer (step 133). If the two adaptive terms are approximately equal (determination 134), then the current adaptive term is validated and should continue to be used in predicting toner usage rates of the printer. A predetermined range may be set within which the two adaptive terms are considered to be sufficiently close or matched that the current adaptive term is validated.

If, however, the current adaptive term does not match the newly-calculated adaptive term, that may indicate that the current adaptive term needs to be adjusted. This may be because conditions have changed that effect the printer's toner usage rate or because the adaptive term does not yet reflect sufficient printer history to accurately capture the printer's toner usage behavior. Therefore, if the current adaptive term does not match the newly-calculated adaptive term, the current adaptive term can be adjusted (step 135).

The current adaptive term can be adjusted in a number of ways. For example, the current adaptive term can be arithmetically or geometrically averaged with the newly-calculated adaptive term. This average may be weighted to reflect the amount of historical data represented in the current adaptive term. In some embodiments, the current adaptive term may simply be replaced with the newly-calculated term.

Limits may be placed, however, on the adjustment of the current adaptive term. For example, if the current toner cartridge is defective, for example, it leaks, the toner in the cartridge may be expended very quickly for reasons that have nothing to do with the printer and that will not likely be repeated with a replacement cartridge. Consequently, if the newly-calculated adaptive term varies from the current adaptive term by more than a predetermined limit, the newly-calculated adaptive term may be treated as anomalous, that is ignored entirely or weighted very low in any adjustment made to the current adaptive term. In this way, an anomalous experience with one toner cartridge will not skew the value of the adaptive term and its ability to predict the performance of future toner cartridges in the printer.

It should be noted, however, that the cartridge does not have to be fully depleted prior to replacement for the method described here to be implemented. Some users may chose to replace a toner cartridge before it is fully depleted to prevent any down-time associated with replacing a fully depleted cartridge. Consequently, in some examples, there are other points late in the life of the cartridge at which some amount of toner remains and the percentage or amount of tone remaining can be accurately determined, for example, using some type of sensor. In such cases, even though the cartridge is not fully depleted, one can still correlate the quantity of ink expended, i.e., something less than 100%, with the amount of printing actually accomplished with that quantity of ink and can then update the adaptive term accordingly.

Figure 4:
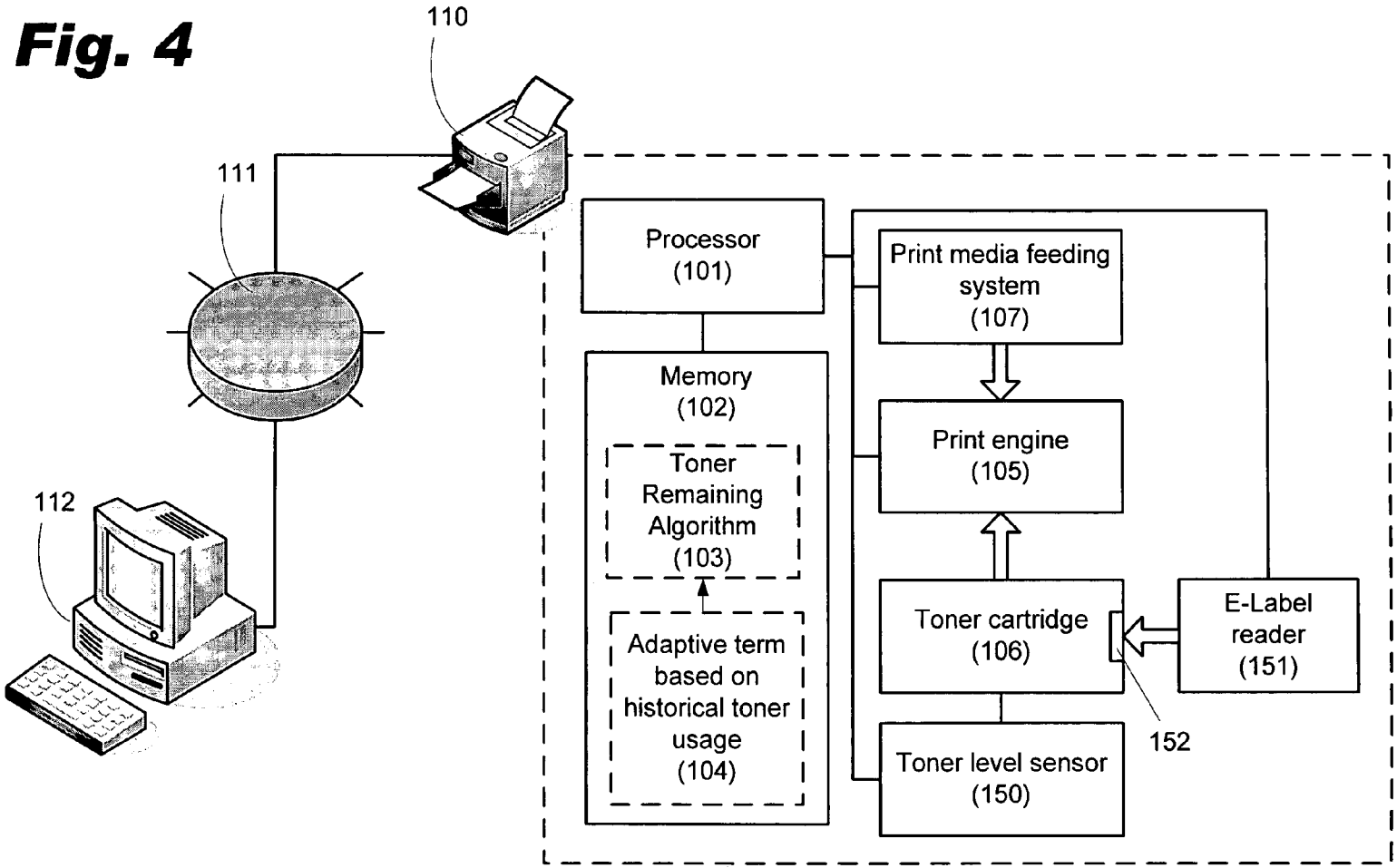
FIG. 4 illustrates a system according to principles described herein that allows an estimate of toner quantity remaining in a printer based on historical toner usage behavior for that particular printer.

In some such examples, referring to FIG. 4, a toner level sensor (TLS) (150) is active, particularly, late in the life of the cartridge, and provides indications of the amount of toner remaining to the toner remaining algorithm (103) or other firmware. Using the output of the sensor (150), the algorithm (103) stores a number of parameters in the memory (102), including (1) Percent toner remaining as measured by the TLS, (2) the "Number indicating wear incurred," and (3) the "Number indicating the number and tone of pixels printed." These parameters are overwritten regularly, for example, with each new page printed so that only the most recent values are stored in memory.

Also in memory (102), the identity of the cartridge in use can be stored. This identity can be determined, for example, from an e-label (152) on that cartridge (106). If the e-label changes, when the change of label is detected by an e-label reader (151), it is determined that the cartridge has been replaced. The algorithm (103) then recalls and uses the last recorded parameters in memory as the "final result" from the previous cartridge (106).

At that point, the actual amount of toner used (as determined by the TLS) can be substituted into the equation and solved for the new Adaptive term as follows:

[Actual toner used from TLS−(Number indicating wear incurred)*(Wear Constant)]/[(Number indicating number and tone of pixels printed)*(Pixel Constant)]=Adaptive Term That new adaptive term would then be averaged and range checked, as described above, before being used.

Thus, in the method of FIG. 3, the adaptive term can be updated at any point that the amount of toner remaining in the cartridge is known or independently determined, whether that remaining quantity is zero or merely near zero.

Accuracy of toner remaining is an issue for pay-for-print applications, cartridge inventory and reorder functions, as well as general customer satisfaction. Greater accuracy, may enable toner level sensor systems to be simplified and development time reduced, reducing both development and production unit costs.

The preceding description has been presented only to illustrate and describe embodiments of the invention. It is not intended to be exhaustive or to limit the invention to any precise form disclosed. Many modifications and variations are possible in light of the above teaching.

What is claimed is:

1. A method of estimating toner remaining in a toner cartridge installed in a printer, the method comprising:

estimating toner remaining in said toner cartridge installed in said printer using an adaptive term, said adaptive term being an expression comprising a value that is adjusted based on actual printer toner usage for a different toner cartridge previously installed in said printer;

calculating a value for said adaptive term when an amount of toner remaining is known or said toner cartridge is fully depleted; and comparing said calculated value with a current value of said adaptive term;

wherein, if said calculated value and said current value of said adaptive term are not within a predetermined range, said method further comprises adjusting said current value based on said calculated value of said adaptive term.

2. The method of claim 1, further comprising using said adaptive term to calculate an estimate of a quantity of toner used prior to estimating toner remaining.

3. The method of claim 2, wherein using said adaptive term to calculate an estimate of a quantity of toner used is performed using a formula in which quantity of toner used=(number indicating wear incurred)·(wear constant)+(number indicating the number and tone of pixels printed)·(pixel constant)·(said adaptive term).

4. The method of claim 1, further comprising using said estimate of a quantity of toner used to estimate an amount of toner remaining in said toner cartridge.

5. The method of claim 4, further comprising reporting said estimate of an amount of toner remaining to a user.

6. The method of claim 1, further comprising tracking a number of pages printed to be used in determining said actual printer toner usage for said toner cartridge previously installed in said printer.

7. The method of claim 1, further comprising tracking a number of pixels printed to be used in determining said actual printer toner usage for said toner cartridge previously installed in said printer.

8. The method of claim 1, wherein, if said calculated value and said current value of said adaptive term are within a predetermined range, further comprising validating said current adaptive term.

9. The method of claim 1, wherein said adjusting comprises substituting said calculated value for said current value of said adaptive term.

10. The method of claim 1, wherein said adjusting comprises averaging said calculated value and said current value of said adaptive term to produce a new current value of said adaptive term.

11. The method of claim 1, wherein, if said calculated value differs from said current value by more than a predetermined limit, said method further comprises treating said calculated value as anomalous.

12. A printer comprising:

a processor;

a print engine;

a toner remaining algorithm for execution by said processor; and an adaptive term, said adaptive term being an expression comprising a value that is adjusted based on a prior toner usage rate for said printer;

wherein said algorithm uses said adaptive term to produce an estimate of an amount of toner remaining in a toner cartridge;

wherein said algorithm is configured to use said adaptive term to calculate an estimate of a quantity of toner used which is subtracted from a previous estimate of an amount of toner remaining so as to produce a current estimate of an amount of toner remaining in said cartridge; and wherein said algorithm comprises a formula in which quantity of toner used=(number indicating wear incurred)·(wear constant)+(number indicating the number and tone of pixels printed)·(pixel constant)·(said adaptive term).

13. The printer of claim 12, wherein said printer is further configured to report said estimate of an amount of toner remaining to a user.

14. The printer of claim 13, further comprising a network connection for reporting said estimate to said user.

15. The printer of claim 12, wherein said printer is configured to count a number indicative of cartridge wear and a number of pixels printed that is used to produce said estimate of an amount of toner remaining in said toner cartridge.

16. A printer comprising:

a processor;

a print engine;

a toner remaining algorithm for execution by said processor; and an adaptive term, said adaptive term being an expression comprising a value that is adjusted based on a prior toner usage rate for said printer;

wherein said algorithm uses said adaptive term to produce an estimate of an amount of toner remaining in a toner cartridge;

wherein said algorithm is configured to calculate a value for said adaptive term when an amount of toner remaining is known or said toner cartridge is fully depleted; and wherein said algorithm is further configured to compare said calculated value with a current value of said adaptive term and, if said calculated value and said current value do not match within a predetermined range, said algorithm is further configured to adjust said current value based on said calculated value of said adaptive term.

17. The printer of claim 16, wherein algorithm adjusts said current value by substituting said calculated value for said current value of said adaptive term.

18. The printer of claim 16, wherein algorithm adjusts said current value by averaging said calculated value and said current value of said adaptive term to produce a new current value of said adaptive term.

19. The printer of claim 16, wherein, if said calculated value varies from said current value by more than a predetermined limit, said algorithm treats said calculated value as anomalous.

* * * * *